United States Patent [19]

Brinkmeier

[11] 4,117,771

[45] Oct. 3, 1978

[54] APPARATUS FOR FORMING BUNDLES OF FLATTENED BAGS

[75] Inventor: Friedhelm Brinkmeier, Lengerich, Fed. Rep. of Germany

[73] Assignee: Windmoller & Holscher, Lengerich, Fed. Rep. of Germany

[21] Appl. No.: 784,466

[22] Filed: Apr. 4, 1977

[30] Foreign Application Priority Data

Jun. 29, 1976 [DE] Fed. Rep. of Germany ..... 2629064

[51] Int. Cl.[2] ..... B31B 1/98

[52] U.S. Cl. ..... 93/93 HT; 214/7; 214/8.5 SS

[58] Field of Search ..... 214/7, 8.5 SS; 271/213; 93/93 R, 93 C, 93 DP, 8 R, 93 HT

[56] References Cited

U.S. PATENT DOCUMENTS

| | | | |
|---|---|---|---|
| 2,070,568 | 2/1937 | Almgren | 214/7 |
| 2,761,676 | 9/1956 | Sabee et al. | 93/93 R X |
| 3,391,806 | 7/1968 | Geis et al. | 93/93 C X |
| 3,748,973 | 7/1973 | Kuck | 93/93 DP |
| 3,777,906 | 12/1973 | Stolzmann et al. | 93/93 R X |

*Primary Examiner*—James F. Coan
*Attorney, Agent, or Firm*—Fleit & Jacobson

[57] ABSTRACT

In an apparatus for forming bundles of flattened bags and successively transporting said bundles away, a rotary cylinder deposits successive bags edgewise on a depositing table disposed between the cylinder and a stationary support. The bags are accumulated in juxtaposition on the table to form a stack and gripper means periodically withdraw a bundle of bags from the stack by passing through the table between the cylinder and the support. The gripper means are non-coterminous with the space between the cylinder and the support so that they withdraw a bundle containing fewer bags than are contained in the stack.

3 Claims, 3 Drawing Figures

APPARATUS FOR FORMING BUNDLES OF FLATTENED BAGS

The invention relates to an apparatus for forming bundles of flattened bags and successively transporting said bundles away, wherein the bags are successively deposited edgewise on a table by means of a rotary depositing cylinder, the table being disposed substantially radially with respect to the cylinder, and gripper means are adapted to pass through the table in a direction opposite to the direction of rotation of the cylinder to lift a bundle of the juxtaposed bags from the table, means being provided to hold the deposited bags in juxtaposition substantially perpendicular to the table.

In an apparatus of this kind known from DT-PS No. 2 039 942, the means for holding the deposited bags substantially perpendicular to the table are constituted by holding fingers in the form of leaf springs which press the bags to the surface of the depositing cylinder. To carry away the bags that have accumulated on the depositing table, the gripper means are passed through the depositing table from beneath same whenever a predetermined number of bags has accumulated on the table. The depositing cylinder is grooved and the gripper means engage in said grooves and remove the accumulated stack of bags as rapidly as possible so that following bags arriving on the depositing cylinder and to be allocated to the next stack will not be impeded as they are deposited on the table. The resilient holdingfingers spring back towards the cylinder as soon as an accumulated stack has been withdrawn so as to hold the next lot of bags substantially perpendicular to the depositing table.

In another apparatus that is known from DT-OS No. 2 443 912, cam control means are effective to swing away from the depositing cylinder a chain guide used for moving part of the gripper means.

Although the known apparatuses have for the most part proved satisfactory in practice, the controls required for rapidly moving the gripper means to take the accumulated bags away cause the construction to become expensive. Further, the gripper means are subjected to high accelerations so that the respective constructional components undergo considerable wear. Finally, and this is especially so in a case where the flattened bags are deposited at a high rate, it is by no means certain that the bags will always be properly deposited and taken away.

It is an object of the present invention to provide a constructionally simpler apparatus that is subjected to less wear and will ensure efficient operation even in conjunction with bag-making machinery from which the bags are issued at a high rate.

According to the invention, the bags are held on the depositing table by laterally mounted brushes or the like and the gripper means terminate short of the surface of the depositing cylinder so as to engage and take away only a proportion of the bags deposited on the table. By means of the lateral brushes disposed adjacent the depositing table, the bags arriving on the depositing cylinder are reliably held edgewise on the table in a position substantially perpendicular thereto, whereby the stack of deposited bags rose continuously and is advanced along the table. By reason of the fact that the gripper means dip into the stack and withdraw only a proportion of the bags on the table, it is not necessary for the gripper means to be moved very rapidly away from the depositing cylinder so as not to impede subsequent bags arriving on the depositing cylinder. In the apparatus of the invention, control means for the rapid withdrawal movement of the gripper means are dispensed with, thereby considerably simplifying the construction and minimising wear. The invention is instrumental in simplifying not only the retention of the deposited bags on the table but also their transport away from the table.

In the apparatus according to the invention the last few bags of a stack are not withdrawn and taken away suddenly. Instead, they remain on the depositing table until they have been displaced by subsequently arriving bags into the range of the gripper means. Bags constructed by an adhesive process are therefore given adequate time to dry and they will be sufficiently strong and stable by the time they are taken away in bundles.

The means for holding the deposited bags in juxtaposition on the depositing table need not be brushes but may be formed by any elements having a similar function, for example foam rubber.

Other features of the invention will become evident from the following description of an example illustrated in the accompanying drawing, wherein.

Figure 1:
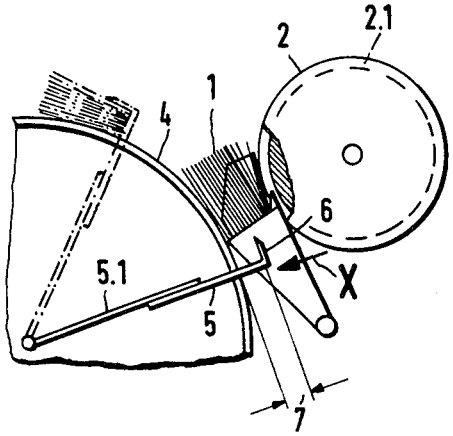
FIG. 1 is an end elevation of the apparatus.
Figure 2:
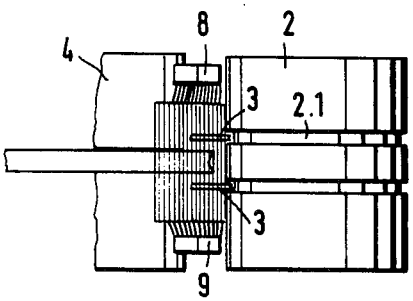
FIG. 2 is a plan view of the apparatus.
Figure 3:
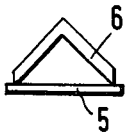
FIG. 3 is an elevation viewed in the direction of the arrow X in FIG. 1.

A rotary depositing cylinder 2 successively delivers bags 1 from a bag-making machine (not shown) to a stationary depositing table 3 which is formed by a grating consisting of bars engaging in grooves 2.1 of the cylinder 2. A supporting plate 4 is provided at a spacing from the depositing cylinder 2 equal to approximately twice the height of each bundle that is to be withdrawn by gripper means 5. The bags arriving on the cylinder 2 are accumulated on the depositing table 3 between the cylinder 2 and the supporting plate 4 and the gripper means 5 take a proportion of these accumulated bags away in the form of a bundle. The gripper means 5 comprise a swing arm 5.1 carrying a triangular blade 6 at its end. The length of the swing arm 5.1 is adjustable so that the spacing 7 between the blade 6 and the supporting plate 4 can be selected at will. The spacing 7 corresponds to the height of each bundle to be transported away. On each occasion that the gripper means 5 pass through the depositing table 3, the triangular blade 6 will dip into the stack of flattened bags supported on the table and take away a bundle of predetermined height as is shown in chain-dotted lines in FIG. 1.

When the apparatus is started, the correct number of bags to be contained in each bundle will be obtained after about the second or third bundle that is taken away by the gripper means 5. The bags 1 accumulated on the depositing table 3 are held edgewise thereon by means of brushes 8, 9 laterally disposed at each side of the table.

After the gripper means 5 have been swung to take a bundle of bags away, they may be returned to their starting position as shown in full lines whilst the blade 6 is retracted to beneath the supporting plate 4, the blade being projected again after they have reached their starting position.

I claim:

1. Apparatus for forming bundles of flattened bags and successively transporting said bundles away, comprising a depositing table; a rotary depositing cylinder effective to deposit successive said bags edgewise on the depositing table, said table being disposed substantially radially with respect to said cylinder; resilient holding means for resiliently holding said deposited bags in juxtaposition substantially perpendicular to said table to form a stack and disposed laterally of said table and axially of said cylinder; and gripper means for separating a bundle from said stack of juxtaposed bags from said table and for lifting said separated bundle from said table, said gripper means being adapted to pass through a portion of said stack and said depositing table in a direction opposite to the direction of rotation of said cylinder so that said bundle of bags lifted thereby contains only part of said stack of juxtaposed bags on said depositing table, the length of said gripper means being adjustable to vary the size of said bundle lifted by said gripping means.

2. The apparatus defined in claim 1, wherein said resilient holding means comprise brushes.

3. The apparatus as defined in claim 1, wherein said gripper means comprises a swing arm carrying a flanged triangular blade at its end.

* * * * *